US008921287B2

(12) United States Patent
Komatsubara et al.

(10) Patent No.: US 8,921,287 B2
(45) Date of Patent: Dec. 30, 2014

(54) LUBRICATING OIL COMPOSITION

(75) Inventors: Hitoshi Komatsubara, Yokohama (JP); Masato Takahashi, Yokohama (JP); Shigeki Matsui, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 763 days.

(21) Appl. No.: 12/092,412

(22) PCT Filed: Nov. 1, 2006

(86) PCT No.: PCT/JP2006/322326

§ 371 (c)(1),
(2), (4) Date: May 2, 2008

(87) PCT Pub. No.: WO2007/052833

PCT Pub. Date: May 10, 2007

(65) Prior Publication Data

US 2009/0275491 A1 Nov. 5, 2009

(30) Foreign Application Priority Data

Nov. 2, 2005 (JP) ..... 2005-319878
Nov. 2, 2005 (JP) ..... 2005-319880

(51) Int. Cl.
*C10M 133/44* (2006.01)
*C10M 163/00* (2006.01)

(52) U.S. Cl.
CPC ..... *C10M 163/00* (2013.01); *C10M 2215/28* (2013.01); *C10M 2223/049* (2013.01); *C10M 2209/084* (2013.01); *C10N 2230/74* (2013.01); *C10N 2210/02* (2013.01); *C10N 2230/06* (2013.01); *C10N 2240/042* (2013.01); *C10M 2219/046* (2013.01); *C10N 2230/76* (2013.01); *C10M 2215/223* (2013.01); *C10M 2203/1006* (2013.01); *C10N 2240/045* (2013.01); *C10M 2207/262* (2013.01); *C10M 2215/064* (2013.01)
USPC ..... 508/192; 508/440; 508/442; 508/460

(58) Field of Classification Search
CPC ..... C10M 163/00; C10M 2203/1006; C10M 2207/262; C10M 2209/084; C10M 2215/064; C10M 2215/223; C10M 2215/28; C10M 2219/046; C10M 2223/049; C10M 2215/086; C10N 2210/02; C10N 2230/06; C10N 2230/74; C10N 2230/76; C10N 2240/042; C10N 2240/045
USPC ..... 508/175, 440, 442, 460, 518, 192
See application file for complete search history.

(56) References Cited

U.S. PATENT DOCUMENTS 3,853,772 A 12/1974 Adams
3,904,537 A 9/1975 Ripple
4,089,790 A 5/1978 Adams
4,216,100 A 8/1980 Yaffe
4,497,719 A 2/1985 King et al.
4,761,482 A 8/1988 Karol
5,164,102 A 11/1992 Everett et al.
5,358,650 A 10/1994 Srinivasan et al.
5,571,445 A 11/1996 Srinivasan et al.
5,703,022 A 12/1997 Floyd
5,739,088 A 4/1998 Inoue et al.
5,817,605 A 10/1998 Papay
6,001,780 A 12/1999 Ho et al.
6,054,418 A 4/2000 Lacome et al.
6,136,759 A 10/2000 Takagi et al.
6,147,035 A 11/2000 Sougawa et al.
6,232,275 B1 5/2001 Ichihashi et al.
6,303,546 B1 10/2001 Hata et al.
6,310,010 B1 10/2001 Higton et al.
6,323,162 B1 11/2001 Yasunori et al.
6,451,745 B1 * 9/2002 Ward ..... 508/192
6,534,450 B1 3/2003 Harrison et al.
6,569,818 B2 5/2003 Nakazato et al.
6,593,281 B2 7/2003 Sato et al.
6,613,722 B1 9/2003 Watts et al.
6,617,286 B2 9/2003 Sato et al.
6,632,781 B2 10/2003 Harrison et al.
6,638,897 B2 10/2003 Ogano et al.

(Continued)

FOREIGN PATENT DOCUMENTS

EP 0695798 A2 2/1996
EP 0 882 781 A2 12/1998

(Continued)

OTHER PUBLICATIONS

Int'l Search Report issued on Nov. 5, 2002 in Int'l Application No. PCT/JP02/09122.

(Continued)

*Primary Examiner* — James Goloboy
*Assistant Examiner* — Latosha Hines
(74) *Attorney, Agent, or Firm* — Panitch Schwarze Belisario & Nadel LLP

(57) ABSTRACT

The present invention provides a lubricating oil composition with excellent torque capacity and shifting characteristics suitable for use as automatic or continuously variable transmission fluids, which composition comprises a base oil and, on the basis of the total mass of the composition, (A) a sulfonate detergent in an amount of 0.01 to 0.3 percent by mass in terms of metal (MeA); (B) a salicylate detergent in an amount of 0 or more than 0 and 0.1 percent by mass or less, in terms of metal (MeB); and (C) a boron-containing succinimide type ashless dispersant in an amount of 0.001 to 0.1 percent by mass in terms of boron (BoC); (MeB)/(MeA) being 0, or greater than 0 and 1.5 or less, and (MeA)/(BoC) being from 0.001 to 20.

6 Claims, No Drawings

(56) References Cited

U.S. PATENT DOCUMENTS

| | | | | |
|---|---|---|---|---|
| 6,720,293 | B2 | 4/2004 | Bovington et al. | |
| 6,737,387 | B2 | 5/2004 | Buitrago et al. | |
| 6,815,401 | B2 | 11/2004 | Nakamura | |
| 6,828,285 | B2 | 12/2004 | Nakamura | |
| 6,828,286 | B2 | 12/2004 | Komiya et al. | |
| 6,841,521 | B2 | 1/2005 | Boffa et al. | |
| 6,855,675 | B1 | 2/2005 | Yamada et al. | |
| 7,018,958 | B2 | 3/2006 | Arrowsmith et al. | |
| 7,026,273 | B2 | 4/2006 | Robson et al. | |
| 7,371,710 | B2 | 5/2008 | Morita | |
| 2001/0034305 | A1 * | 10/2001 | Komatsubara | 508/192 |
| 2001/0044389 | A1 | 11/2001 | Komiya et al. | |
| 2002/0002120 | A1 | 1/2002 | Gahagan | |
| 2003/0013619 | A1 * | 1/2003 | Sato et al. | 508/192 |
| 2004/0005988 | A1 * | 1/2004 | Watanabe et al. | 508/192 |
| 2004/0110647 | A1 | 6/2004 | Gapinski | |
| 2004/0171500 | A1 * | 9/2004 | Morita | 508/192 |
| 2004/0176258 | A1 * | 9/2004 | Morita | 508/158 |
| 2004/0176260 | A1 | 9/2004 | Shirahama et al. | |
| 2004/0192562 | A1 * | 9/2004 | Morita | 508/185 |
| 2005/0026790 | A1 * | 2/2005 | Komatsubara et al. | 508/160 |
| 2005/0101494 | A1 * | 5/2005 | Iyer et al. | 508/192 |
| 2005/0130855 | A1 * | 6/2005 | Yagishita | 508/440 |
| 2005/0261147 | A1 | 11/2005 | Rosenbaum et al. | |
| 2006/0111255 | A1 | 5/2006 | Shirahama et al. | |
| 2006/0131210 | A1 | 6/2006 | Rosenbaum et al. | |
| 2007/0287643 | A1 | 12/2007 | Matsui et al. | |

FOREIGN PATENT DOCUMENTS

| | | | |
|---|---|---|---|
| EP | 1104800 | A2 | 6/2001 |
| EP | 1136544 | A1 | 9/2001 |
| GB | 2 360 528 | A | 9/2001 |
| JP | 06184578 | A | 7/1994 |
| JP | 07-268375 | A | 10/1995 |
| JP | 09-111275 | A | 4/1997 |
| JP | 10-025487 | A | 1/1998 |
| JP | 10-306292 | A | 11/1998 |
| JP | 11-50077 | A | 2/1999 |
| JP | 11-181464 | A | 7/1999 |
| JP | 11269477 | A | 10/1999 |
| JP | 11286696 | A | 10/1999 |
| JP | 2000-063869 | A | 2/2000 |
| JP | 2000034491 | A | 2/2000 |
| JP | 2000063878 | A | 2/2000 |
| JP | 2000-109867 | A | 4/2000 |
| JP | 2000-109872 | A | 4/2000 |
| JP | 2000-109875 | A | 4/2000 |
| JP | 2000-355695 | A | 12/2000 |
| JP | 2001-279286 | A | 10/2001 |
| JP | 2001-323292 | A | 11/2001 |
| JP | 2001-342486 | A | 12/2001 |
| JP | 2002003875 | A | 1/2002 |
| JP | 2002129182 | A | 5/2002 |
| JP | 2002275488 | A | 9/2002 |
| JP | 2002-544372 | A | 12/2002 |
| JP | 2003-041283 | A | 2/2003 |
| JP | 2003-82376 | A | 3/2003 |
| JP | 2003-82377 | A | 3/2003 |
| JP | 2003-113391 | A | 4/2003 |
| JP | 2003-514099 | A | 4/2003 |
| JP | 2003-321695 | A | 11/2003 |
| JP | 2004-262979 | A | 9/2004 |
| JP | 2004-331721 | A | 11/2004 |
| JP | 2005-8695 | A | 1/2005 |
| JP | 2005-139446 | A | 6/2005 |
| WO | 9637585 | A1 | 11/1996 |
| WO | 9714773 | A1 | 4/1997 |
| WO | 00/70001 | A1 | 11/2000 |
| WO | 0134735 | A1 | 5/2001 |
| WO | 02070636 | A1 | 9/2002 |
| WO | WO2004/013264 | * | 2/2004 |

OTHER PUBLICATIONS

Int'l Preliminary Report on Patentability issued on Aug. 29, 2003 in Int'l Application No. PCT/JP02/09122.
Int'l Search Report issued on Nov. 5, 2002 in Int'l Application No. PCT/JP02/09123.
Int'l Preliminary Examination Report issued on Aug. 29, 2003 in Int'l Application No. PCT/JP02/09123.
Office Action issued Aug. 22, 2006 in U.S. Appl. No. 10/797,386.
Office Action issued May 18, 2007 in U.S. Appl. No. 10/797,386.
Office Action issued Sep. 7, 2006 in U.S. Appl. No. 10/797,387.
Office Action issued Apr. 12, 2007 in U.S. Appl. No. 10/797,387.
Office Action issued Jan. 9, 2008 in U.S. Appl. No. 10/797,387.
Office Action issued Apr. 3, 2007 in U.S. Appl. No. 10/816,274.
Office Action issued Jan. 9, 2008 in U.S. Appl. No. 10/816,274.
Office Action issued Sep. 22, 2008 in U.S. Appl. No. 10/816,274.
Office Action issued Apr. 10, 2009 in U.S. Appl. No. 10/816,274.
Int'l Search Report issued on Dec. 24, 2002 in Int'l Application No. PCT/JP02/10279.
Office Action dated Dec. 2, 2009 in U.S. Appl. No. 11/757,109.
Office Action dated May 27, 2009 in U.S. Appl. No. 11/757,109.

* cited by examiner

LUBRICATING OIL COMPOSITION

CROSS-REFERENCE TO RELATED APPLICATION

This application is a Section 371 of International Application No. PCT/JP2006/322326, filed Nov. 1, 2006, which was published in the English language on May 10, 2007, under International Publication No. WO 2007/052833 A1, and the disclosure of which is incorporated herein by reference.

FIELD OF THE INVENTION

The present invention relates to lubricating oil compositions with excellent torque capacity and shifting characteristics, suitable for use as automatic transmissions and/or continuously variable transmission fluids.

BACKGROUND OF THE INVENTION

Recent automatic transmissions have been demanded to be light and small and sought to be improved in power transmission capability in connection with the increased power output of the engines with which the transmissions are used in combination. There are some automatic transmissions or continuously variable transmissions that control the lock-up clutch built in the torque converter to be slipped at a low velocity (slip lock-up control). These transmissions have been improved with the slip lock-up control so that the drive feeling can be improved by absorbing a torque variation and the engine torque can be transmitted to the transmission mechanism efficiently. Some of the continuously variable transmissions are provided with a wet starting clutch which is initially allowed to slip and then coupled so as to start the vehicle smoothly from the halt, that is a so-called slip control. Lubricating oils used for the transmissions wherein slip control for the lock-up clutch or starting clutch is carried out are required to provide excellent torque capacity and less shifting shock as well as to have excellent and long-lasting initial anti-shudder properties.

There have been proposed transmission fluids, in which a friction modifier, a metallic detergent, an ashless dispersant, and an anti-wear agent are optimally added so as to retain the friction characteristics of a lock-up clutch in a good condition and provide long-lasting initial anti-shudder properties (see Patent Documents 1 to 7 below).

For example, Patent Document 1 discloses a transmission lubricating oil composition comprising a specific calcium salicylate, an SP-based extreme pressure additive, a specific succinimide and a boron-containing ashless dispersant, each in a specific amount, which composition exhibits excellent properties such as excellent anti-shudder properties and long-lasting fatigue life. Patent Document 2 discloses a continuously variable transmission lubricating oil composition containing an organic acid metal salt with a specific structure, an anti-wear agent, and a boron-containing succinimide, as essential components, which composition has both higher friction coefficient between metals and anti-shudder properties for a slip control mechanism. Patent Document 3 discloses a long-lasting continuously variable transmission lubricating oil composition comprising calcium salicylate, a phosphorous-containing anti-wear agent, a friction modifier, and a dispersant type viscosity index improver, which composition has both a higher friction coefficient between metals and anti-shudder properties for a slip control mechanism. Patent Document 4 discloses a lubricating oil composition comprising a dithiocarbamate compound, a condensate of a branched fatty acid having 8 to 30 carbon atoms and amine, and an aminic anti-oxidant, which composition has excellent and long-lasting anti-shudder properties. Patent Document 5 discloses an automatic transmission fluid composition comprising calcium sulfonate, phosphorous acid esters and further a sarcosine derivative or a reaction product of a carboxylic acid and amine, which composition has long-lasting anti-shudder properties for a slip lock-up mechanism and long-lasting properties to prevent scratch noise in a belt type continuously variable transmission. Patent Document 6 discloses an automatic transmission fluid composition comprising a specific alkaline earth metal sulfonate in a specific amount, which composition is excellent in oxidation stability as a fluid used for an automatic transmission with a slip control mechanism and has long-lasting anti-shudder properties. Patent Document 7 discloses an automatic transmission fluid comprising calcium salicylate, magnesium salicylate, a specific amount of a friction modifier and a specific amount of a boric acid-modified succinimide, with excellent anti-shudder properties and a certain torque capacity.

However, according to studies conducted by the inventors of the present invention, it was found that the use of a salicylate detergent as a metallic detergent made it difficult to retain sufficient torque capacity at high temperatures. It was also found that when a sulfonate detergent was used, the resulting composition was still insufficient in anti-shudder properties and often failed to retain sufficient torque capacity. On the other hand, it was found that an enhancement in torque capacity caused wet-type friction materials to wear severely and that the long use of the resulting composition made it difficult to retain initial torque capacity and shifting characteristics sufficiently and anti-shudder durability tended to be poor. For wet-type friction materials containing carbonaceous materials, which is excellent in heat resistance, such as carbon fiber, graphite, and carbon black, there is concern that conventional transmission fluids can not exhibit the above-described performances and in particular would be poor in anti-shudder properties due to the adsorptivity of various additives to the materials.

Therefore, there is a need for a lubricating oil composition with high torque capacity and excellent shifting characteristics, suitable for use as a transmission fluid for automatic transmissions and/or continuously variable transmissions, and such a lubricating oil composition is importantly enhanced in anti-shudder properties and suppress wet-type friction materials from wearing while retaining the foregoing properties. Further, there has been a demand for a transmission fluid having no problem in exhibiting the foregoing properties for carbon-containing friction materials, composed of mainly aramid fiber or cellulose fiber and containing fiber or filler made of carbon.

(1) Patent Document 1: Japanese Patent Laid-Open Publication No. 2003-113391
(2) Patent Document 2: Japanese Patent Laid-Open Publication No. 2001-323292
(3) Patent Document 3: Japanese Patent Laid-Open Publication No. 2000-355695
(4) Patent Document 4: Japanese Patent Laid-Open Publication No. 11-50077
(5) Patent Document 5: Japanese Patent Laid-Open Publication No. 10-306292
(6) Patent Document 6: Japanese Patent Laid-Open Publication No. 10-25487
(7) Patent Document 7: Japanese Patent Laid-Open Publication No. 2000-63869

DISCLOSURE OF THE INVENTION

In view of the above-described circumstances, the present invention has an object to provide a lubricating oil composition with excellent torque capacity and shifting characteristics, suitable for use as automatic transmissions and/or continuously variable transmission fluids. Furthermore, the present invention has an object to provide a lubricating oil composition that in addition to the foregoing properties is also excellent in anti-shudder properties or that in addition to the foregoing properties is also excellent in anti-wear properties for wet-type friction materials and anti-shudder durability while retaining the initial torque capacity and shifting characteristics for a long period of time, suitable for use as automatic transmission and/or continuously variable transmission fluids. The composition of the present invention not only can exhibit these extremely excellent properties for conventional paper friction materials but also has no problem in exhibiting these properties particularly for wet-type friction materials containing carbonaceous materials.

As the results of extensive studies conducted by the inventors of the present invention to achieve the above objects, the present invention was accomplished on the basis of the finding that the foregoing objects were able to be accomplished with a lubricating oil composition comprising a sulfonate detergent, a salicylate detergent and a boron-containing succinimide additive, each in a specific amount and a specific amount ratio.

That is, the present invention provides a lubricating oil composition comprising a base oil and, on the basis of the total mass of the composition, (A) a sulfonate detergent in an amount of 0.01 to 0.3 percent by mass in terms of metal (MeA);

(B) a salicylate detergent in an amount of 0 or more than 0 and 0.1 percent by mass or less, in terms of metal (MeB); and (C) a boron-containing succinimide type ashless dispersant in an amount of 0.001 to 0.1 percent by mass in terms of boron (BoC);

(MeB)/(MeA) being 0, or greater than 0 and 1.5 or less, (MeA)/(BoC) being from 0.001 to 20.

EFFECTS OF THE INVENTION

The lubricating oil composition of the present invention has excellent torque capacity, shifting characteristics and anti-shudder properties or while retaining these performance further has excellent anti-wear properties for wet-type friction materials and anti-shudder durability and can retain the initial torque capacity and shifting characteristics for a long period of time. Therefore, the lubricating oil composition is particularly suitable for use as automatic transmission and/or continuously variable transmission fluids.

BEST MODE FOR CARRYING OUT THE INVENTION

The present invention will be described in more detail below.

There is no particular restriction on the lubricating base oil of the lubricating oil composition of the present invention. Therefore, the lubricating base oil may be a mineral base oil or a synthetic base oil.

Specific examples of the mineral oil include those which can be produced by subjecting a lubricating oil fraction produced by vacuum-distilling an atmospheric distillation bottom oil resulting from atmospheric distillation of a crude oil, to any one or more treatments selected from solvent deasphalting, solvent extraction, hydrocracking, solvent dewaxing, and hydrorefining; wax-isomerized mineral oils; and those produced by isomerizing GTL WAX (Gas to Liquid Wax).

Examples of the synthetic lubricating base oil include polybutenes and hydrogenated compounds thereof; poly-α-olefins such as 1-octene oligomer and 1-decene oligomer, and hydrogenated compounds thereof; diesters such as ditridecyl glutarate, di-2-ethylhexyl adipate, diisodecyl adipate, ditridecyl adipate and di-2-ethylhexyl sebacate; polyol esters such as neopentyl glycol ester, trimethylolpropane caprylate, trimethylolpropane pelargonate, pentaerythritol-2-ethylhexanoate and pentaerythritol pelargonate; aromatic synthetic oils such as alkylnaphthalenes, alkylbenzenes, and aromatic esters; and mixtures of the foregoing.

Examples of the lubricating base oil which may be used in the present invention include the above-described mineral base oils and synthetic base oils and mixtures of two or more oils selected from these base oils. For example, the base oil used in the present invention may be one or more of the mineral base oils or synthetic base oils or a mixed oil of one or more of the mineral base oils and one or more of the synthetic base oils.

There is no particular restriction on the kinematic viscosity of the lubricating base oil of the present invention. However, the lubricating base oil is preferably so adjusted that the kinematic viscosity at 100° C. is preferably from 2 to 8 $mm^2/s$, more preferably from 2.5 to 6 $mm^2/s$, particularly preferably from 3 to 4.5 $mm^2/s$. A base oil with a kinematic viscosity at 100° C. of greater than 8 $mm^2/s$ is not preferable because the resulting lubricating oil composition would be poor in low temperature viscosity characteristics while a base oil with a kinematic viscosity at 100° C. of less than 2 $mm^2/s$ is not also preferable because the resulting lubricating oil composition would be poor in lubricity due to its insufficient oil film formation at lubricating sites and large in evaporation loss of the lubricating base oil.

There is no particular restriction on the sulfur content in the lubricating base oil. However, the sulfur content is preferably 0.1 percent by mass or less, more preferably 0.05 percent by mass or less, more preferably 0.01 percent by mass or less.

There is no particular restriction on the evaporation loss of the lubricating base oil. However, the NOACK evaporation loss is preferably from 10 to 50 percent by mass, more preferably from 20 to 40 percent by mass, particularly preferably from 22 to 35 percent by mass. The use of a lubricating base oil with a NOACK evaporation loss adjusted within the above ranges renders it possible to achieve both low temperature characteristics and anti-wear properties. The term "NOACK evaporation loss" used herein denotes an evaporation loss measured in accordance with CEC L-40-T-87.

Specifically, the lubricating base oil is preferably a mixture of (a) a base oil with a kinematic viscosity at 100° C. of 1.5 to 3.5 $mm^2/s$, preferably 2 to 3.2 $mm^2/s$, more preferably 2.5 to 3 $mm^2/s$, a sulfur content of 0.05 percent by mass or less, preferably 0.01 percent by mass or less, more preferably 0.005 percent by mass or less and a NOACK evaporation loss of 20 to 80 percent by mass, preferably 30 to 65 percent by mass, more preferably 30 to 55 percent by mass and (b) a base oil with a kinematic viscosity at 100° C. of 3.5 to 6 $mm^2/s$, preferably 3.8 to 4.5 $mm^2/s$, more preferably 3.9 to 4.5 $mm^2/s$, a sulfur content of 0.05 percent by mass or less, preferably 0.01 percent by mass or less, more preferably 0.005 percent by mass or less, and a NOACK evaporation loss of 5 to 20 percent by mass, preferably 10 to 18 percent by mass, more preferably 12 to 16 percent by mass, mixed at a mass ratio of 10:90 to 90:10, preferably 25:75 to 75:25, more preferably 40:60 to 60:40 so that the kinematic viscosity at 100° C., sulfur content and NOACK evaporation loss of the mixed base oils are within the above-described ranges. As the result, it is rendered possible to produce a composition having both low temperature characteristics and lubricating properties suitable for a transmission oil composition.

Optionally, the above-described mixed base oil may contain a base oil with a kinematic viscosity at 100° C. of 6 $mm^2/s$ or greater, preferably 10 to 35 $mm^2/s$, a sulfur content of 0.05 to 1 percent by mass, preferably 0.1 to 0.7 percent by mass, more preferably 0.2 to 0.6 percent by mass, and a NOACK evaporation loss of 10 percent by mass or less, preferably 5 percent by mass or less, more preferably 3 percent by mass or less, in a small amount, for example 5 to 30 percent by mass.

Component (A) of the lubricating oil composition of the present invention is a sulfonate detergent.

Examples of the sulfonate detergent include alkali metal or alkaline earth metal salts, particularly preferably magnesium and/or calcium salts, of alkyl aromatic sulfonic acids, produced by sulfonating an alkyl aromatic compound having a molecular weight of 100 to 1,500, preferably 200 to 700. Specific examples of the alkyl aromatic sulfonic acids include petroleum sulfonic acids and synthetic sulfonic acids. The petroleum sulfonic acids may be those produced by sulfonating an alkyl aromatic compound contained in the lubricant fraction of a mineral oil or may be mahogany acid by-produced upon production of white oil. The synthetic sulfonic acids may be those produced by sulfonating an alkyl benzene having a straight-chain or branched alkyl group, produced as a by-product from a plant for producing an alkyl benzene used as the raw material of a detergent or produced by alkylating polyolefin to benzene, or those produced by sulfonating dinonylnaphthalene. There is no particular restriction on the sulfonating agent used for sulfonating these alkyl aromatic compounds. The sulfonating agent may be a fuming sulfuric acid or sulfuric acid.

The alkaline earth metal sulfonates include not only neutral alkaline earth metal sulfonates produced by reacting the above-mentioned alkyl aromatic sulfonic acid directly with an alkaline earth metal base such as an oxide or hydroxide of an alkaline earth metal such as magnesium and/or calcium or produced by once converting the alkyl aromatic sulfonic acid to an alkali metal salt such as a sodium salt or a potassium salt and then substituting the alkali metal salt with an alkaline earth metal salt; but also basic alkaline earth metal sulfonates produced by heating such neutral alkaline earth metal salts and an excess amount of an alkaline earth metal salt or an alkaline earth metal base (hydroxide or oxide) in the presence of water; and carbonate overbased alkaline earth metal sulfonates and borate overbased alkaline earth metal sulfonates produced by reacting such neutral alkaline earth metal sulfonates with an alkaline earth metal base in the presence of carbonic acid gas and/or boric acid or borate.

The sulfonate detergent referred herein may be any of the above-described neutral alkaline earth metal sulfonate, basic alkaline earth metal sulfonate, overbased alkaline earth metal sulfonate and mixtures thereof.

Component (A) used in the present invention is preferably a calcium sulfonate detergent or a magnesium sulfonate detergent, particularly preferably a calcium sulfonate detergent because it is excellent in an effect to enhance torque capacity.

Although sulfonate detergents are usually commercially available as diluted with a light lubricating base oil, it is preferred to use a sulfonate detergent whose metal content is from 1.0 to 20 percent by mass, preferably from 2.0 to 16 percent by mass.

The base number of the sulfonate detergent used in the present invention is optional and usually from 0 to 500 mgKOH/g. However, it is preferred to use a sulfonate detergent with a base number preferably from 100 to 450 mgKOH/g, more preferably from 200 to 400 mgKOH/g because it is excellent in an effect to enhance torque capacity.

The term "base number" used herein denotes a base number measured by the perchloric acid potentiometric titration method in accordance with section 7 of JIS K2501 "Petroleum products and lubricants-Determination of neutralization number".

The content of Component (A) in the lubricating oil composition of the present invention is from 0.01 to 0.3 percent by mass, preferably from 0.02 to 0.2 percent by mass, particularly preferably from 0.04 to 0.15 percent by mass in terms of metal (MeA), on the basis of the total mass of the composition. The content of Component (A) within these ranges renders it possible to produce a lubricating oil composition which is excellent in torque capacity, shifting characteristics and anti-shudder properties. With the objective of further enhancing torque capacity and shifting characteristics, the content of Component (A) is preferably from 0.05 to 0.3 percent by mass, more preferably from 0.1 to 0.25 percent by mass, in terms of metal (MeA) on the basis of the total mass of the composition.

Component (B) used in the lubricating oil composition of the present invention is a salicylate detergent. There is no particular restriction on the structure of Component (B). However, the salicylate detergent is preferably a metal salt, preferably alkali metal or alkaline earth metal salt, particularly preferably magnesium and/or calcium salt of an salicylic acid having one or two alkyl group having 1 to 40 carbon atoms.

Component (B) is preferably a salicylate detergent containing a dialkylsalicylic acid metal salt, particularly preferably an alkylsalicylic acid metal salt and/or an (overbased) basic salt thereof, wherein the component ratio of the monoalkylsalicylic acid metal salt is from 85 to 100 percent by mole, the component ratio of the dialkylsalicylic acid metal salt is from 0 to 15 percent by mole and the component ratio of the 3-alkylsalicylic acid metal salt is from 40 to 100 percent by mole with the objective of further enhancing anti-shudder durability.

The term "monoalkylsalicylic acid metal salt" used herein denotes an alkylsalicylic acid metal salt having one alkyl group, such as a 3-alkylsalicylic acid metal salt, a 4-alkylsalicylic acid metal salt, and a 5-alkylsalicylic acid metal salt. The component ratio of the monoalkylsalicylic acid metal salt is from 85 to 100 percent by mole, preferably from 88 to 98 percent by mole, more preferably from 90 to 95 percent by mole, on the basis of 100 percent by mole of the alkylsalicylic acid metal salt. The component ratio of the alkylsalicylic acid metal salt other than the monoalkylsalicylic acid metal salt, such as dialkylsalicylic acid metal salts is from 0 to 15 percent by mole, preferably from 2 to 12 percent by mole, more preferably from 5 to 10 percent by mole. The component ratio of the 3-alkylsalicylic acid metal salt is from 40 to 100 percent by mole, preferably from 45 to 80 percent by mole, more preferably from 50 to 60 percent by mole, on the basis of 100 percent by mole of the alkylsalicylic acid metal salt. The total component ratio of the 4-alkylsalicyclic acid metal salt and 5-alkylsalicylic acid metal salt corresponds to the component ratio of the alkylsalicylic acid metal salt excluding the 3-alkylsalicylic acid metal salt and dialkylsalicylic acid metal salt and is from 0 to 60 percent by mole, preferably from 20 to 50 percent by mole, more preferably from 30 to 45 percent by mole, on the basis of 100 percent by mole of the alkylsalicylic acid metal salt. Inclusion of a slight amount of a dialkylsalicylic acid metal salt renders it possible to produce a composition having both anti-wear properties and low temperature characteristics. The component ratio of the 3-alkylsalicylate of 40 percent by mole or more renders it possible to reduce relatively the component ratio of the 5-alkylsalicylic acid metal salt and thus enhance the oil solubility of the resulting composition.

Examples of the alkyl group of the alkylsalicylic acid metal salt constituting Component (B) include alkyl groups having 10 to 40, preferably 10 to 19 or 20 to 30, more preferably 14 to 18 or 20 to 26, particularly preferably 14 to 18 carbon atoms. Examples of alkyl groups having 10 to 40 carbon atoms include those such as decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups. These alkyl groups may be straight-chain or branched and primary and secondary alkyl groups. However, secondary alkyl groups are preferable because a salicylic acid metal salt satisfying the above-described requirements for Component (B) can be produced easily.

Examples of the metal of the alkylsalicylic acid metal salt include alkali metals such as sodium and potassium, and alkaline earth metals such as calcium and magnesium. The metal is preferably calcium or magnesium, particularly preferably calcium.

There is no particular restriction on the method of producing Component (B) used in the present invention which thus may be produced by any of the known methods. For example, an alkylsalicylic acid containing a monoalkylsalicylic acid as the main component is produced by alkylating 1 mole of a phenol using 1 mole or more of an olefin having 10 to 40 carbon atoms, such as a polymer or copolymer of ethylene, propylene, or butene, preferably a straight-chain α-olefin such as an ethylene polymer, and then carboxylating the alkylated phenol using carbon dioxide gas, or alternatively by alkylating 1 mole of salicylic acid using 1 mole or more of such an olefin preferably such a straight-chain α-olefin. The alkylsalicylic acid is then reacted with a metal base such as an alkali metal or alkaline earth metal oxide or hydroxide or converted to an alkali metal salt such as sodium salt or potassium salt, which alkali metal salt may be further substituted with an alkaline earth metal. Particularly preferably, the reaction ratio of the phenol or salicylic acid to the olefin is adjusted to preferably 1:1 to 1.15 (molar ratio), more preferably 1:1.05 to 1.1 (molar ratio) because the component ratio of the monoalkylsalicylic acid metal salt to dialkylsalicylic acid metal salt is easily adjusted to the desired ratio required for Component (B) specified in the present invention. Further, particularly preferably a straight-chain α-olefin is used as the olefin because the component ratio of the 3-alkylsalicylic acid metal salt, 5-alkylsalicylic acid metal salt, or the like is easily adjusted to the desired ratio as required for Component (B), and an alkylsalicylic acid metal salt having a secondary alkyl group which is preferable in the present invention can be obtained as the main component. The use of a branched olefin as the above-mentioned olefin is not preferable because only the 5-alkylsalicylic acid metal salt is easily produced, but it is necessary to improve the oil solubility by mixing the 3-alkylsalicylic acid metal salt so as to produce Component (B) with the structure specified by the present invention, making the process variable.

Component (B) used in the present invention also includes basic salts produced by heating an alkali metal or alkaline earth metal salicylate (neutral salt) produced as described above, together with an excess amount of an alkali metal or alkaline earth metal salt or an alkali metal or alkaline earth metal base (hydroxide or oxide of an alkali metal or alkaline earth metal) in the presence of water; and overbased salts produced by reacting such a neutral salt with a base such as a hydroxide of an alkali metal or alkaline earth metal in the presence of carbonic acid gas, boric acid or borate.

These reactions are generally carried out in a solvent (aliphatic hydrocarbon solvents such as hexane, aromatic hydrocarbon solvents such as xylene, and light lubricating base oil). It is preferred to use a solvent whose metal content is within the range of 1.0 to 20 percent by mass, preferably 2.0 to 16 percent by mass.

Most preferred for Component (B) used in the present invention are alkylsalicylic acid metal salts and/or (overbased) basic salts thereof, the component ratios of which monoalkylsalicylic acid metal salt and dialkylsalicylic acid metal salt are from 85 to 95 percent by mole and from 5 to 15 percent by mole respectively, and 3-alkylsalicylic acid metal salt, and both 4-alkylsalicylic acid metal salt and 5-alkylsalicylic acid metal salt are from 50 to 60 percent by mole and from 35 to 45 percent by mole respectively, because the resulting lubricating oil composition will be excellent in initial anti-shudder properties. The alkyl group referred herein is particularly preferably a secondary alkyl group.

The base number of Component (B) used in the present invention is usually from 0 to 500 mgKOH/g, preferably from 20 to 300 mgKOH/g, particularly preferably from 100 to 200 mgKOH/g. One or more compound with a base number in these ranges may be used. The term "base number" used herein denotes a base number measured by the perchloric acid potentiometric titration method in accordance with section 7 of JIS K2501 "Petroleum products and lubricants-Determination of neutralization number".

The content of Component (B) in the lubricating oil composition of the present invention is from 0.001 to 0.1 percent by mass, preferably from 0.005 to 0.08 percent by mass, more preferably from 0.01 to 0.04 percent by mass in terms of metal (MeB) on the basis of the total mass of the composition because the content renders it possible to produce a lubricating oil composition which excels in torque capacity, shifting characteristics and anti-shudder properties in a well-balanced manner. With the objective of further enhancing anti-shudder properties and retaining torque capacity and shifting characteristics in a well-balanced manner, the content of Component (B) is preferably from 0.005 to 0.05 percent by mass, more preferably from 0.008 to 0.02 percent by mass in terms of metal (MeB) on the basis of the total amount of the composition.

Component (C) of the lubricating oil composition of the present invention is a boron-containing succinimide type ashless dispersant.

Examples of the boron-containing succinimide type ashless dispersant include those produced by modifying a succinimide having at least one alkyl or alkenyl group having preferably 40 to 400 carbon atoms, more preferably 60 to 350 carbon atoms per molecule, with boric acid or borate. The succinimide may be of mono or bis type but is particularly preferably of bis type. As long as Component (C) contains boron, it may be any of those produced by one or more modification selected from those using a monocarboxylic acid (fatty acid or the like) having 2 to 30 carbon atoms, a polycarboxylic acid having 2 to 30 carbon atoms, such as oxalic acid, phthalic acid, trimellitic acid, or pyromellitic acid, a phosphorous-containing acid such as phosphorous acid or phosphoric acid, and a sulfur-containing compound.

The alkyl or alkenyl group having 40 to 400 carbon atoms may be straight-chain or branched but is preferably branched. Specific examples include branched alkyl or alkenyl groups having 40 to 400, preferably 60 to 350 carbon atoms, derived from an oligomer of an olefin such as propylene, 1-butene, or isobutylene, or a cooligomer of ethylene and propylene. An alkyl or alkenyl group having fewer than 40 carbon atoms would result in a compound with less dissolubility in a lubricating base oil while an alkyl or alkenyl group having more than 400 carbon atoms would cause the resulting composition to be poor in low-temperature fluidity.

The content of Component (C) in the lubricating oil composition of the present invention is from 0.001 to 0.1 percent by mass, preferably from 0.005 to 0.08 percent by mass, more preferably from 0.01 to 0.05 percent by mass, particularly preferably from 0.015 to 0.025 percent by mass in terms of born (BoC) on the basis of the total mass of the composition. The content of Component (C) within these ranges renders it possible to produce a lubricating oil composition which excels in torque capacity, shifting characteristics and anti-shudder properties in a well-balanced manner. In order to further improve anti-shudder durability, the content is preferably 0.04 percent or less, particularly preferably 0.02 percent by mass or less in terms of boron. With the objective of further improving anti-shudder durability and shifting characteristics, the content is preferably 0.02 percent by mass or less, more preferably 0.01 percent by mass or less in terms of boron. With the objective of enhancing torque capacity, particularly at high temperatures and lessening the change in torque capacity caused by temperature variations while retaining anti-shudder durability and shifting characteristics, the content is preferably 0.01 percent by mass or more, more preferably 0.015 percent by mass or more in terms of boron. The content of Component (C) is usually from 0.05 to 0.4 percent by mass, preferably from 0.01 to 0.2 percent by mass, more preferably from 0.02 to 0.15 percent by mass in terms of nitrogen on the basis of the total mass of the composition. With the objective of further improving anti-shudder durability, the content is preferably 0.10 percent by mass or less, more preferably 0.08 percent by mass or less, particularly preferably 0.05 percent by mass or less in terms of nitrogen.

In the lubricating oil composition of the present invention, the mass ratio of Components (A) and (B) defined by ((MeB)/(MeA)) is 0 or 0 or greater and 1.5 or less, preferably from 0.01 to 1.5, more preferably from 0.05 to 1.4, more preferably from 0.1 to 1, more preferably 0.15 to 0.8, particularly preferably from 0.2 to 0.4.

The use of Components (A) and (B) in combination can improve anti-shudder durability more and retaining torque capacity at high temperatures at a higher lever than the single use of each component.

The mass ratio of Components (A) and (C) defined by ((MeA)/(BoC)) is from 0.001 to 20, preferably from 0.1 to 10, more preferably from 0.5 to 5, more preferably from 1 to 3.5, particularly preferably from 1.5 to 3.2.

When (MeB)/(MeA) is 0, it is preferable because torque capacity can be increased and with the objective of further enhancing torque capacity, BoC is preferably from 0.04 to 0.1 percent by mass, more preferably from 0.05 to 0.08 percent by mass while with the objective of further improving shifting characteristics and anti-shudder durability, BoC is preferably from 0.001 to 0.04 percent by mass, more preferably from 0.01 to 0.035 percent by mass. When (MeB)/(MeA) is greater than 0 and 1.5 or less, preferably from 0.01 to less than 1, more preferably from 0.05 to 0.8, BoC is preferably less than 0.04 percent by mass, more preferably less than 0.025 percent by mass, more preferably less than 0.02 percent by mass and MeA/BoC is preferably from 2 to 10, more preferably from 2.5 to 5 with the objective of producing a lubricating oil composition which can keep torque capacity high and has excellent anti-shudder properties and shifting characteristics. With the objective of enhancing torque capacity particularly at high temperatures and lessening the temperature dependency of torque capacity while retaining anti-shudder durability and shifting characteristics, BoC is preferably from 0.01 to 0.1 percent by mass, more preferably from 0.015 to 0.06 percent by mass and MeA/BoC is preferably from 0.1 to 5, more preferably from 1.0 to 3.2, particularly preferably from 2 to 3.0.

Preferably, the lubricating oil composition of the present invention further comprises (D) a triazole-type compound.

There is no particular restriction on (D) a triazole-type compound as long as it is recognized that the compound can exhibit anti-wear properties for wet-type friction materials. Examples of such a compound include (hydrocarbyl)benzotriazole and derivatives thereof, represented by formula (1):

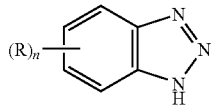

(1)

In formula (1), R is a hydrocarbyl group having 1 to 30, preferably 1 to 8 carbon atoms. Examples of the hydrocarbyl group include alkyl, alkenyl, (alkyl)aryl, and arylalkyl groups (alkyl and alkenyl groups may be straight-chain or branched), which may contain an oxygen-containing substituent such as hydroxy, alkoxy, or carboxyl group. The letter "n" indicates an integer of 0 to 3, preferably 0 to 2, particularly preferably 1.

Preferred examples of (hydrocarybyl)benzotriazoles represented by formula (1) include benzotriazole; and alkylbenzotriazoles having 1 to 3 straight-chain or branched alkyl group having 1 to 4 carbon atoms, such as methyl, ethyl, n-propyl, isopropyl, n-butyl, isobutyl, sec-butyl and tert-butyl groups. In view of excellent anti-oxidation properties, (hydrocarbyl)bonzotriazoles represented by formula (1) are preferably compounds wherein R is methyl or ethyl and n is 1 or 2. Specific examples of such compounds include methylbenzotriazole(tolyltriazole) dimethylbenzotriazole, ethylbenzotriazole, ethylmethylbenzotriazole, diethylbenzotriazole, and mixtures thereof.

Examples of (hydrocarbyl)benzotriazole derivatives include those produced by allowing (hydrocarbyl)benzotriazoles represented by formula (1) to react with at least one compound selected from amines, aldehydes, carboxylic acids, and alcohols.

Preferred examples include amine salts of (hydrocarbyl) benzotriazoles, hydrocarbylamino(hydrocarbyl)benzotriazole, equimolar reaction products of (hydrocarbyl)benzotriazoles, amines, and aldehydes, equimolar reaction products of (hydrocarbyl)benzotriazoles, alcohols, and aldehydes.

Examples of amine include primary or secondary hydrocarbylamines having 1 to 30 carbon atoms (hydrocarbyl group is one or more type of group selected from alkyl, alkenyl, (alkyl)aryl, arylalkyl and alkanol groups), polyamines having 1 to 10 alkyleneamino groups having 1 to 10 carbon atoms, and derivatives thereof.

Examples of aldehydes include formaldehyde, paraformaldehyde, hydrocarbyl aldehydes having 1 to 30 carbon atoms (hydrocarbyl group is one or more type of group selected from alkyl, alkenyl, (alkyl)aryl, arylalkyl and alkanol groups).

Examples of carboxylic acids include formic acid and hydrocarbyl carboxylic acids (hydrocarbyl group is one or more type of group selected from alkyl, alkenyl, (alkyl)aryl, arylalkyl and alkanol groups). These carboxylic acids may be monobasic acids or polybasic acids.

Examples of alcohols include hydrocarbyl carboxylic acids (hydrocarbyl group is one or more type of group selected from alkyl, alkenyl, (alkyl)aryl, arylalkyl and alkanol groups), which may be monohydric or polyhydric alcohols.

Preferred examples of Component (D) include benzotriazole, tolyltriazole, salts of benzotriazole or tolyltriazole and an amine such as oleylamine, dioctylaminomethylbenzotriazole, dioctylaminomethyltolyltriazole, condensates of benzotriazole or tolyltriazole, acetaldehyde and monooctylamine at 1:1:1 (molar ratio), and condensates of benzotriazole or tolyltriazole, formaldehyde and tridecylalcohol at 1:1:1 (molar ratio). More preferred are tolyltriazole and derivatives thereof and most preferred is tolyltriazole.

The content of Component (D) when contained in the lubricating oil composition of the present invention is from 0.01 to 5 percent by mass, preferably from 0.05 to 1 percent by mass, particularly preferably from 0.1 to 0.2 percent by mass on the basis of the total mass of the composition. Addition of Component (D) renders it possible to further enhance torque capacity, significantly suppress wet-type friction materials from wearing and retain torque capacity and shifting characteristics at a high level for a long period of time. Further, Component (D) is contributive to increasing the durability of wet-type friction materials and anti-shudder properties.

Preferably, the lubricating oil composition of the present invention further comprises (E) a friction modifier.

The friction modifier used as Component (F) may be any compound that has been usually used as a friction modifier for a lubricating oil. Specific examples include amine-, imide-, amide-, and fatty acid-type friction modifiers, each having in their molecules at least one alkyl or alkenyl group having 6 to 30 carbon atoms, particularly a straight-chain alkyl or alkenyl group having 6 to 30 carbon atoms.

Examples of the amine-type friction modifiers include those such as straight-chain or branched, preferably straight-chain aliphatic monoamines, aliphatic alkanolamines, and aliphatic polyamines, each having 6 to 30 carbon atoms, and alkyleneoxide adducts of these aliphatic amines.

Examples of the imide-type friction modifiers include succinimide-type friction modifiers such as mono and/or bis succinimides having one or two straight-chain or branched, preferably branched hydrocarbon group having 6 to 30, preferably 8 to 18 carbon atoms, and succinimide-modified compounds produced by allowing such succinimides to react with one or more compounds selected from boric acid, phosphoric acid, carboxylic acids having 1 to 20 carbon atoms, and sulfur-containing compounds.

Examples of the amide-type friction modifiers include fatty acid amide-type friction modifiers such as amides of straight-chain or branched, preferably straight-chain fatty acids having 7 to 31 carbon atoms and ammonia, aliphatic monoamines, or aliphatic polyamines.

Examples of the fatty acid-type friction modifiers include straight-chain or branched, preferably straight-chain fatty acids, fatty acid esters of such fatty acids and aliphatic monohydric alcohols or aliphatic polyhydric alcohols, fatty acid metal salts such as alkaline earth metal salts of such fatty acids (magnesium and calcium salts) and zinc salts of such fatty acids.

In the present invention, the above-described imide-type friction modifiers, in particular succinimide-type friction modifiers not only can enhance the friction coefficient of a wet clutch and thus improve power transmission efficiency but also are effective in significantly improving anti-shudder durability.

The above-described amide-type friction modifiers are particularly preferable because they are excellent in shifting characteristics and anti-shudder durability and can significantly increase torque capacity and can exhibit these effects in particular when (MeB)/(MeA) is 0.

Among the above-described friction modifiers, aliphatic amine-type friction modifiers and fatty acid-type friction modifiers, particularly fatty acid metal salts are particularly preferably used because they can enhance torque capacity and reduce wear of wet-type friction materials more and further is excellent in shifting characteristics and can significantly improve initial anti-shudder properties. The lubricating oil composition particularly preferably contains these aliphatic amine-type friction modifier and/or fatty acid-type friction modifier and can exhibit particularly an effect to increase anti-shudder durability when (MeB)/(MeA) is greater than 0 and less than 1.5 or an (alkyl)arylphosphite is used. When an aliphatic amine-type friction modifier is used in combination with a fatty acid-type friction modifier, there is no particular restriction on the mass ratio. However, the mass ratio is preferably from 1:5 to 5:1, more preferably from 1:3 to 3:1, particularly preferably from 1:2 to 2:1.

In the present invention, the lubricating oil composition may contain any one compound or two or more compounds selected from the above-exemplified friction modifiers in an any amount. However, the content is usually from 0.01 to 5.0 percent by mass, preferably from 0.03 to 3.0 percent by mass, on the basis of the total mass of the composition.

Preferably, the lubricating oil composition of the present invention further comprises (F) a phosphorous-containing anti-wear agent.

There is no particular restriction on the phosphorous-containing anti-wear agent used as Component (F) as long as it contains phosphorous in its molecules. Examples of the phosphorous-containing anti-wear agent include phosphoric acid monoesters, phosphoric acid diesters, phosphoric acid triesters, phosphorous acid monoesters, phosphorous acid diesters, phosphorous acid triesters, thiophosphoric acid monoesters, thiophosphoric acid diesters, thiophosphoric acid triesters, thiophosphorous acid monoesters, thiophosphorous acid diesters, and thiophosphorous acid triesters, each having a hydrocarbon group having 1 to 30 carbon atoms, salts of these esters and amines or alkanolamines, and metal salts such as zinc salt of these esters. Examples of the hydrocarbon group having 1 to 30 carbon atoms include alkyl, cycloalkyl, alkenyl, alkyl-substituted cycloalkyl, aryl, alkyl-substituted aryl, and arylalkyl groups and one or more of these groups may be contained.

Preferable phosphorous-containing anti-wear agents are phosphorous or phosphoric acid esters having an alkyl group having 4 to 20 carbon atoms or an (alkyl)aryl group having 6 to 12 carbon atoms and one compound or a mixture of two or more compounds selected from amine salts produced by allowing these esters to react with an alkylamine having an alkyl group having 1 to 18 carbon atoms. More preferred are one compound or a mixture of two or more compounds selected from phosphorous acid esters having an alkyl group having 4 to 20 carbon atoms, such as dibutylphoshite and phosphorous acid esters having an (alkyl)aryl group having 6 to 12 carbon atoms, such as phenylphosphite. Particularly preferred are phosphorous acid diesters having an (alkyl) aryl group having 6 to 12 carbon atoms, such as diphenylphosphite.

The content of (F) a phosphorous-containing anti-wear agent, when contained, in the lubricating oil composition of the present invention is usually from 0.01 to 5 percent by mass and in terms of phosphorous preferably from 0.001 to 0.1 percent by mass, each on the basis of the total amount of the composition. Although the advantageous effects of the present invention are achieved even though the phosphorous-containing anti-wear agent is contained in a low concentration such as 0.005 percent by mass or less, the content thereof is preferably from 0.005 to 0.08 percent by mass, more preferably from 0.01 to 0.06 percent by mass, particularly preferably from 0.02 to 0.05 percent by mass with the objective of further enhancing anti-wear properties for metal materials and anti-shudder durability.

The content of the phosphorous-containing anti-wear agent within the above ranges renders it possible to produce a lubricating oil composition which is excellent in anti-wear properties and initial anti-shudder properties and easy to retain the latter for a long period of time.

There is no particular restriction on the mass ratio of the content of Component (A) in terms of metal (MeA) to the content of the phosphorous-containing anti-wear agent in terms of phosphorous (P), i.e., ((MeA)/(P)). However, the mass ratio is preferably from 0.1 to 250, more preferably from 0.5 to 50, more preferably from 0.8 to 5, particularly preferably from 1 to 3. The mass ratio of the content of Component (A) to that of the phosphorous-containing anti-wear agent in terms of phosphorous (P) within the above ranges renders it possible to produce a lubricating oil composition which is excellent in anti-wear properties and initial anti-shudder properties and easy to retain the latter for a long period of time.

The lubricating oil composition of the present invention excels in torque capacity, shifting characteristics and anti-shudder properties in a well-balanced manner due to the above-described component structure. However, in order to further enhance the performance of the lubricating oil composition of the present invention or provide the composition with necessary performances as a lubricating oil composition, it may be blended with various known additives. Examples of such additives include ashless dispersants other than Component (C), metallic detergents other than Components (A) and (B), anti-oxidants, extreme pressure additives, viscosity index improvers, metal deactivators, rust inhibitors, corrosion inhibitors, pour point depressants, rubber swelling agents, anti-foaming agents, and dyes. These additives may be used alone or in combination.

The ashless dispersant may be any of those usually used in a lubricating oil. Examples of the ashless dispersant include nitrogen-containing compounds such as succinimides, benzylamines and polyamines, each having in their molecules at least one alkyl or alkenyl group having 40 to 400, preferably 60 to 350 carbon atoms, and derivatives or modified products thereof. The alkyl or alkenyl group having 40 to 400 carbon atoms may be straight-chain or branched and is preferably a branched alkyl or alkenyl group derived from an oligomer of an olefin such as propylene, 1-butene, or isobutylene, or a cooligomer of ethylene and propylene. The alkyl or alkenyl group of fewer than 40 carbon atoms would cause the poor dissolubility of the compound in the lubricating base oil while the alkyl or alkenyl group of more than 40 carbon atoms would degrade the low-temperature fluidity of the resulting lubricating oil composition.

Specific examples of the derivatives or modified products of nitrogen-containing compounds exemplified as an example of ashless dispersants include an acid-modified compound produced by allowing any of the above-described nitrogen-containing compounds to react with a monocarboxylic acid (fatty acids or the like) having 2 to 30 carbon atoms, such as fatty acid or a polycarboxylic acid having 2 to 30 carbon atoms, such as oxalic acid, phthalic acid, trimellitic acid, and pyromellitic acid, so as to neutralize or amidize the whole or part of the remaining amino and/or imino groups; a phosphorous-modified compound produced by allowing any of the above-described nitrogen-containing compounds to react with phosphoric or phosphorous acid, so as to neutralize or amidize the whole or part of the remaining amino and/or imino groups; a sulfur-modified compound produced by allowing any of the above-described nitrogen-containing compounds to react with a sulfuric compound; and modified products produced by a combination of two or more selected from the modifications with acid, phosphorous and sulfur, of the above-described nitrogen-containing compounds.

The lubricating oil composition of the present invention may contain any one compound or two or more compounds, selected from the above-exemplified ashless dispersants in an any amount. However, the content is usually from 0.1 to 10 percent by mass, preferably from 1 to 6 percent by mass on the basis of the total mass of the composition.

The lubricating oil composition of the present invention contains preferably any of these ashless dispersants other than Component (C), which dispersants are preferably boron-free succinimide type ashless dispersants.

The content of the boron-free succinimide type ashless dispersant is usually from 0.005 to 0.4 percent by mass, preferably from 0.01 to 0.2 percent by mass in terms of nitrogen but is more preferably from 0.01 to 0.08 percent by mass, particularly preferably from 0.02 to 0.05 percent by mass because if the content is in excess of 0.1 percent by mass, torque capacity can be increased but shifting characteristics tends to be poor.

The composition of the present invention may contain either Component (C) or Component (C) and an ashless dispersant other than Component (C) but preferably contains it or them so that the mass ratio of the boron content to the nitrogen content contained in these ashless dispersants (B/N ratio) is to be from 0.05 to 1.2. With the objective of further enhancing torque capacity, the B/N ratio is preferably from 0.3 to 1.2, more preferably from 0.4 to 0.8. With the objective of further improving anti-shudder durability, the B/N ratio is more preferably from 0.1 to 0.5, more preferably from 0.13 to 0.35 thereby improving anti-shudder durability, torque capacity and shifting characteristics at a high level in a well-balanced manner.

Examples of the metallic detergents other than Components (A) and (B) include phenate detergents.

Examples of the phenate detergents include alkaline earth metal salts, particularly magnesium salts and/or calcium salts, of an alkylphenolsulfide produced by reacting an alkylphenol having at least one straight-chain or branched alkyl group having 4 to 30, preferably 6 to 18 carbon atoms with sulfur or a Mannich reaction product of an alkylphenol produced by reacting such an alkylphenol with formaldehyde.

The base number of the metallic detergents other than Components (A) and (B) is usually from 0 to 500 mgKOH/g, preferably from 20 to 450 mgKOH/g.

There is no particular restriction on the content of the metallic detergent other than Components (A) and (B) in the lubricating oil composition of the present invention. However, the content is usually from 0.01 to 5 percent by mass, preferably from 0.05 to 1 percent by mass, particularly preferably from 0.1 to 0.5 percent by mass, on the basis of the total mass of the composition.

The anti-oxidant which may be used in the present invention may be any anti-oxidant that is usually used in a lubricating oil, such as phenolic or aminic compounds.

Specific examples of the anti-oxidant include alkylphenols such as 2-6-di-tert-butyl-4-methylphenol; bisphenols such as methylene-4,4-bisphenol(2,6-di-tert-butyl-4-methylphenol); naphthylamines such as phenyl-α-naphthylamine; dialkyldiphenylamines; esters of (3,5-di-tert-butyl-4-hydroxyphenyl)fatty acid (propionic acid) with a monohydric or polyhydric alcohol such as methanol, octadecanol, 1,6-hexanediol, neopentyl glycol, thiodiethylene glycol, triethylene glycol and pentaerythritol; phenothiazines; organic metal anti-oxidants such as molybdenum, copper, and zinc; and mixtures thereof.

One or more of these compounds may be blended in any amount in the lubricating oil composition of the present invention. However, the content of the anti-oxidant is usually from 0.01 to 5.0 percent by mass, on the basis of the total amount of the composition.

In the present invention, it is preferred to use a phenolic anti-oxidant and/or an aminic anti-oxidant and particularly preferred to use a phenolic anti-oxidant and an aminic anti-oxidant in combination because anti-shudder properties can be easily retain for a long period of time. When a phenolic anti-oxidant is used in combination with an aminic anti-oxidant, the mass ratio therebetween is preferably from 1:5 to 10:1, more preferably from 1:1 to 8:1, more preferably from 2:1 to 6:1.

The extreme pressure additive which may be used in the present invention may be any compound that is used as an extreme pressure additive for a lubricating oil. Examples of the extreme pressure additive include sulfuric compounds such as dithiocarbamates, disulfides, sulfurized olefins, and sulfurized fats and oils. One or more of these compounds may be blended in any amount in the lubricating oil composition of the present invention. However, the content is usually from 0.01 to 5.0 percent by mass, on the basis of the total mass of the composition.

Specific examples of the viscosity index improvers include non-dispersant type viscosity index improvers such as polymers or copolymers of one or more monomers selected from various methacrylic acid esters or hydrogenated compounds thereof; and dispersant type viscosity index improvers such as copolymers of various methacrylic acid esters further containing nitrogen compounds. Specific examples of other viscosity index improvers include non-dispersant- or dispersant-type ethylene-α-olefin copolymers of which the α-olefin may be propylene, 1-butene, or 1-pentene, or a hydrogenated compound thereof; polyisobutylenes or hydrogenated compounds thereof; styrene-diene hydrogenated copolymers; styrene-maleic anhydride ester copolymers; and polyalkylstyrenes.

It is necessary to select the molecular weight of these viscosity index improvers, taking account of the shear stability thereof. Specifically, the number-average molecular weight of the non-dispersant or dispersant type polymethacrylate is from 5,000 to 150,000, preferably from 5,000 to 35,000. The number-average molecular weight of polyisobutylenes or hydrogenated compounds thereof is from 800 to 5,000, preferably from 1,000 to 4,000. The number-average molecular weight of ethylene-α-olefin copolymers or hydrogenated compounds thereof is from 800 to 150,000, preferably from 3,000 to 12,000.

One or more compounds selected from these viscosity index improvers may be blended in any amount in the lubricating oil composition of the present invention. However, the content of the viscosity index improver is usually from 0.1 to 20.0 percent by mass, on the basis of the total amount of the composition.

Examples of the metal deactivator include thiazole compounds and thiadiazole compounds. Preferably thiadiazole compounds are used. Examples of thiadiazole compounds include 2,5-bis(alkylthio)-1,3,4-thiadiazole having a straight-chain or branched alkyl group having 6 to 24 carbon atoms; 2,5-bis(alkyldithio)-1,3,4-thiadiazole having a straight-chain or branched alkyl group having 6 to 24 carbon atoms;

2-(alkylthio)-5-mercapto-1,3,4-thiadiazole having a straight-chain or branched alkyl group having 6 to 24 carbon atoms;

2-(alkyldithio)-5-mercapto-1,3,4-thiadiazole having a straight-chain or branched alkyl group having 6 to 24 carbon atoms, and mixtures thereof. Among these, particularly preferred are 2,5-bis(alkyldithio)-1,3,4-thiadiazoles. The content of these metal deactivators is from 0.005 to 0.5 percent by mass on the basis of the total amount of the composition.

Examples of the rust inhibitor include alkenyl succinic acids, alkenyl succinic acid esters, polyhydric alcohol esters, petroleum sulfonates, and dinonylnaphthalene sulfonates.

Examples of the corrosion inhibitors include benzotriazole-, tolyltriazole-, and imidazole-type compounds.

Examples of the pour point depressants include polymethacrylate conforming with a lubricating base oil to be used.

Examples of the rubber swelling agents include aromatic- or ester-type rubber swelling agents.

Examples of the anti-foaming agents include silicones such as dimethylsilicone and fluorosilicone.

Although the contents of these additives are optional, the content of the corrosion inhibitor is from 0.005 to 0.2 percent by mass, the content of anti-foaming agent is from 0.0005 to 0.01 percent by mass, and the content of the other additives is from 0.005 to 10 percent by mass, on the basis of the total amount of the lubricating oil composition of the present invention.

The kinematic viscosity at 100° C. of the lubricating oil composition of the present invention is usually from 2 to 25 $mm^2/s$, preferably from 3 to 15 $mm^2/s$, more preferably from 4 to 10 $mm^2/s$, more preferably from 5 to 7 $mm^2/s$.

The lubricating oil composition of the present invention is excellent in torque capacity and shifting characteristics and further in anti-shudder properties. The composition is further excellent in anti-wear properties for wet-type friction materials and anti-shudder durability and can retain initial torque capacity and shifting characteristics for a long period of time. Therefore, the composition is suitable for use as automatic transmissions and/or continuously variable transmission fluids. Further, the composition exhibits the above significantly excellent properties not only for conventional paper friction materials, for example, carbon-free aramid or cellulose wet-type friction materials but also wet-type friction materials containing carbonaceous materials such as carbon fiber, graphite, and carbon black, for example carbon-containing friction materials composed of mainly aramid or cellulosic fiber and 5 percent by mass or more of fiber or filler made of carbon.

The lubricating oil composition of the present invention is also excellent in performances required for transmission fluids other than those described above and thus is suitably used for the automatic or manual transmission and the differential gears, of automobiles, construction machines and agricultural machines. Moreover, the lubricating oil composition can be used as gear oils for industrial uses; lubricating oils for the gasoline engines, diesel engines or gas engines of automobiles such as two- and four-wheeled vehicles, power generators, and ships; turbine oils; and compressor oils.

APPLICABILITY IN THE INDUSTRY

The lubricating oil composition of the present invention is excellent in torque capacity and shifting characteristics as well as in anti-shudder properties and thus is suitably used as automatic and/or continuously variable transmission fluids.

EXAMPLES

Hereinafter, the present invention will be described in more details by way of the following examples and comparative examples, which should not be construed as limiting the scope of the invention.

Examples 1 to 17 and Comparative Examples 1 to 4

Lubricating oil compositions of Examples 1 to 17 according to the present invention (the kinematic viscosity at 100° C. of each composition was adjusted to about 7 $mm^2/s$) and those of Comparative Examples 1 to 4 for comparison were prepared as set forth in Tables 1 and 2 and subjected to the following evaluation tests to evaluate (1) torque capacity, (2) shifting characteristics, (3) the amount of wear of a friction material after a high load durability test and (4) anti-shudder durability. The results are also set forth in Tables 1 and 2. The ratio of each of the base oils is on the basis of the total mass of the base oil, and the content of each of the additives is on the basis of the total mass of the composition.

(1) Torque Capacity

The torque capacity of each composition was evaluated by measuring μs at temperatures of 100° C. and 140° C. in the static friction test after lapse of 500 cycles using the SAE No. 2 test apparatus in accordance with JASO M348-95 "Test method for friction property of automatic transmission fluids". The temperature dependency of the torque capacity at high temperatures was also calculated in accordance with the following formula.

$$\text{Temperature dependency of torque capacity}=(T100-T140)/40\times10^4$$

T100: Torque capacity at 100° C.

T140: Torque capacity at 140° C.

(2) Shifting Characteristics

The shifting characteristics of each composition was evaluated by measuring the ratio of μ0 to μd, i.e., μ0/μd, in the dynamic friction test measured after lapse of 500 cycles using the SAE No. 2 test apparatus in accordance with JASO M348-95 "Test method for friction property of automatic transmission fluids".

(3) Wear Amount of Friction Material

The high load durability test was carried out using the SAE No. 2 test apparatus in accordance with JASO M348-95 "Test method for friction property of automatic transmission fluids", a part of which condition was changed.

Moment of inertia: 0.05 $Kgfms^2$

Number of revolution: 3000 rpm

Fluid temperature: 100° C.

Surface pressure: 1.3 MPa

The wear amount of a friction material was determined by measuring the wear amount of a paper friction material after lapse of 30000 cycles.

(4) Anti-Shudder Durability

The anti-shudder durability of each composition was evaluated by carrying out a low velocity sliding test in accordance with JASO M349-98 "Automatic transmission fluids-Anti-shudder performance test" so as to compare the anti-shudder durability of the reference fluid prescribed in this method with those of the fluids of Examples and Comparative Examples. A fluid with a durability of 48 hours or longer is regarded as a standard fluid with excellent anti-shudder properties while a fluid with a durability of 120 hours or longer is regarded as a fluid with extremely excellent in anti-shudder durability.

The friction materials used in the above (1) to (3) tests were cellulosic wet-type friction materials.

As apparent from the results set forth in Tables 1 and 2, the compositions of Examples 1 to 17 according to the present invention had high torque capacity, excellent shifting characteristics and long anti-shudder durability. In particular, the compositions of Examples 5 to 8 were high in torque capacity, excellent in shifting characteristics, capable of drastically suppressing friction materials from wearing, and long in anti-shudder durability. It is apparent that the compositions of Examples 9 and 10 were significantly improved in anti-shudder durability and capable of suppressing friction materials from wearing while retaining torque capacity and shifting characteristics at an excellently higher level, due to the use of Component (B). Further, the compositions of Examples 11 to 16 were high in torque capacity, excellent in shifting characteristics, and significantly improved in anti-shudder durability.

On the other hand, it is apparent that torque capacity was extremely small when Component (A) was not contained (Comparative Example 2), (MeB)/(MeA) was in excess of 1.5 (Comparative Example 3), and (MeA)/(BoC) was in excess of 20 (Comparative Examples 1 and 2).

The lubricating oil compositions of Examples 11 to 17 were subjected to the same tests as described above using a carbon-containing friction material composed of mainly aramid or cellulose fiber and containing 5 percent by mass or more of fiber or filler made of carbon, in place of the friction material used above. As the result, it was confirmed that the compositions of Examples 11 to 16 were improved in all torque capacity, temperature dependency thereof, shifting characteristics, and anti-shudder durability and extremely improved in anti-shudder durability compared with the composition of Example 17.

TABLE 1

| | Example 1 | Example 2 | Example 3 | Example 4 | Example 5 | Example 6 | Example 7 | Example 8 | Example 9 | Example 10 | Comparative Example 1 |
|---|---|---|---|---|---|---|---|---|---|---|---|
| Lubricating base oil (on the basis of total mass of base oil, mass %) | | | | | | | | | | | |
| Mineral oil A[1)] | 50 | 50 | 50 | 50 | 50 | 50 | 50 | 50 | 50 | 50 | 50 |
| Mineral oil B[2)] | 50 | 50 | 50 | 50 | 50 | 50 | 50 | 50 | 50 | 50 | 50 |

TABLE 1-continued

| | | Example 1 | Example 2 | Example 3 | Example 4 | Example 5 | Example 6 | Example 7 | Example 8 | Example 9 | Example 10 | Comparative Example 1 |
|---|---|---|---|---|---|---|---|---|---|---|---|---|
| Additives (on th basis of total mass of composition, mass %) | | | | | | | | | | | | |
| (A) | Ca sulfonate[3)] | 1.9 | 1.9 | 0.5 | 1.1 | 1.9 | 1.9 | 1.9 | 1.9 | 0.5 | 1.1 | 1.9 |
| | metal amount (MeA) | 0.24 | 0.24 | 0.06 | 0.14 | 0.24 | 0.24 | 0.24 | 0.24 | 0.06 | 0.14 | 0.24 |
| (B) | Ca salicylate[4)] | | | 0.17 | 0.17 | | | | | 0.17 | 0.17 | |
| | metal amount (MeB) | | | 0.01 | 0.01 | | | | | 0.01 | 0.01 | |
| (C) | Boron-containing succinimide[5)] | 3.3 | 1.6 | 1.0 | 1.0 | 3.3 | 3.3 | 1.6 | 3.3 | 1.0 | 1.0 | 0.5 |
| | boron amount (BoC) | 0.07 | 0.03 | 0.02 | 0.02 | 0.07 | 0.07 | 0.03 | 0.07 | 0.02 | 0.02 | 0.01 |
| (D) | Triazole-type compound[6)] | — | — | — | — | 0.16 | 0.08 | 0.16 | 0.16 | 0.10 | 0.10 | 0.16 |
| (E) | Friction modifier A[7)] | 1.0 | 1.0 | | | 1.0 | 1.0 | 1.0 | | | | 1.0 |
| | Friction modifier B[8)] | | | 0.2 | 0.2 | | | | 0.2 | 0.2 | 0.2 | |
| | Friction modifier C[9)] | | | 0.2 | 0.2 | | | | 0.2 | 0.2 | 0.2 | |
| (F) | Phosphorus-containing anti-wear agent A[10)] | 0.03 | 0.03 | 0.2 | 0.2 | 0.03 | 0.03 | 0.03 | 0.03 | 0.2 | 0.2 | 0.03 |
| Other additives | Ashless dispersant B[11)] | 1.6 | 1.6 | 1.8 | 1.8 | 1.6 | 1.6 | 1.6 | 1.6 | 1.8 | 1.8 | 1.6 |
| | Other additives[12)] | 16 | 16 | 16.0 | 16.0 | 16 | 16 | 16 | 16 | 16.0 | 16.0 | 16 |
| (MeB)/(MeA) (mass ratio) | | 0 | 0 | 0.17 | 0.17 | 0 | 0 | 0 | 0 | 0.17 | 0.07 | 0 |
| (MeA)/(BoC) (mass ratio) | | 3.4 | 8.0 | 3.0 | 7.0 | 3.4 | 3.4 | 8.0 | 3.4 | 3.0 | 7.0 | 24.0 |
| Torque capacity (T100) μs (100° C.) | | 0.138 | 0.112 | 0.115 | 0.109 | 0.141 | 0.141 | 0.122 | 0.130 | 0.125 | 0.120 | 0.075 |
| Shifting characteristics μ0/μd | | 0.96 | 0.91 | 0.98 | 0.97 | 0.95 | 0.95 | 0.93 | 0.94 | 1.00 | 0.99 | 0.95 |
| Wear amount of friction material (μm) | | 280 | 200 | 210 | 230 | 110 | 160 | 105 | 100 | 90 | 100 | 100 |
| Anti-shudder durability h | | — | — | — | — | 96 | 96 | 120 | 48 | 168 | 168 | — |

1)hydrocracked base oil (100° C. kinematic viscosity: 2.6 $mm^2/s$ viscosity index: 105, NOACK evaporation loss: 52 mass %, S: 0.1 mass % or less)
2)hydrocracked base oil (100° C. kinematic viscosity: 4.0 $mm^2/s$ viscosity index: 125, NOACK evaporation loss: 16 mass %, S: 0.1 mass % or less)
3)calcium sulfonate (base number: 300 mgKOH/g)
4)calcium carbonate overbased salt of alkylsalicylic acid calcium salt having C14 to C18 secondary alkyl group (Base number: 170 mg KOH/g, Ca: 6 mass %, Structure of alkylsalicylic carbonate: 3-alkyl: 53 mol %, 4-alkyl: 4 mol %, 5-alkyl: 35 mol %, 3,5-dialkyl: 8 mol %)
5)boric acid-modified polybutenyl succinimide (Mn of PIB group: 1300, nitrogen: 2.3 mass %, boron: 2.0 mass %, B/N ratio: 0.87)
6)tolyltriazole
7)amide-type friction modifier
8)fatty acid-type friction modifier
9)amine-type friction modifier
10)diphenylphosphite (phosphorus content: 13.2 mass %)
11)polybutenyl succinimide (Mn of PIB group: 1300, nitrogen: 2.2 mass %)
12)including anti-oxidant, viscosity index improver and the like

TABLE 2

| | | Example 11 | Example 12 | Example 13 | Example 14 | Example 15 | Example 16 | Example 17 | Comparative Example 2 | Comparative Example 3 | Comparative Example 4 |
|---|---|---|---|---|---|---|---|---|---|---|---|
| Lubricating base oil (on the basis of total mass of base oil, mass %) | | | | | | | | | | | |
| Mineral oil A[1)] | | 50 | 50 | 50 | 50 | 50 | 50 | 50 | 50 | 50 | 50 |
| Mineral oil B[2)] | | 50 | 50 | 50 | 50 | 50 | 50 | 50 | 50 | 50 | 50 |
| Additives (on th basis of total mass of composition, mass %) | | | | | | | | | | | |
| (A) | Ca sulfonate[3)] | 0.35 | 0.35 | 0.35 | 0.35 | 1.00 | 0.20 | 0.35 | — | 0.35 | 0.35 |
| | metal amount (MeA) | 0.04 | 0.04 | 0.04 | 0.04 | 0.125 | 0.025 | 0.04 | — | 0.04 | 0.04 |
| (B) | Ca salicylate[4)] | 0.25 | 0.5 | 0.17 | 1.0 | 0.25 | 0.25 | — | 0.5 | 2.0 | 0.25 |
| | metal amount (MeB) | 0.015 | 0.03 | 0.01 | 0.06 | 0.015 | 0.015 | — | 0.03 | 0.12 | 0.015 |
| (C) | Boron-containing succinimide[5)] | a | a | a | c | b | c | a | a | a | a |
| | boron amount (BoC) | 0.006 | 0.013 | 0.015 | 0.025 | 0.06 | 0.05 | 0.013 | 0.013 | 0.013 | 0.002 |
| (E) | Friction modifier[6)] | 0.4 | 0.4 | 0.4 | 0.4 | 0.4 | 0.4 | 0.4 | 0.4 | 0.4 | 0.4 |
| (F) | Phosphorus-containing anti-wear agent A[7)] | 0.2 | 0.2 | 0.2 | 0.2 | 0.2 | 0.2 | 0.2 | 0.2 | 0.2 | 0.2 |
| Other additives | Ashless dispersant[8)] | 3.0 | 3.0 | 3.0 | 3.0 | 3.0 | 3.0 | 3.0 | 3.0 | 3.0 | 3.0 |
| | Anti-oxidant A[9)] | 0.5 | 0.5 | 0.5 | 0.5 | 0.5 | 0.5 | 0.5 | 0.5 | 0.5 | 0.5 |
| | Anti-oxidant B[10)] | 1.0 | 1.0 | 1.0 | 1.0 | 1.0 | 1.0 | 1.0 | 1.0 | 1.0 | 1.0 |
| | Viscosity index improver[11)] | 10 | 10 | 10 | 10 | 10 | 10 | 10 | 10 | 10 | 10 |
| (MeB)/(MeA) (mass ratio) | | 0.34 | 0.68 | 0.23 | 1.36 | 0.12 | 0.60 | 0 | — | 2.73 | 0.34 |
| (MeA)/(BoC) (mass ratio) | | 7.3 | 3.4 | 2.9 | 1.8 | 2.1 | 0.5 | 3.4 | 0.0 | 3.4 | 22.0 |
| Torque capacity (T100) μs(100° C.) | | 0.116 | 0.117 | 0.120 | 0.124 | 0.125 | 0.120 | 0.118 | 0.090 | 0.092 | 0.085 |

TABLE 2-continued

| | Example 11 | Example 12 | Example 13 | Example 14 | Example 15 | Example 16 | Example 17 | Comparative Example 2 | Comparative Example 3 | Comparative Example 4 |
|---|---|---|---|---|---|---|---|---|---|---|
| Torque capacity (T140) μs(140° C.) | 0.097 | 0.104 | 0.112 | 0.118 | 0.119 | 0.113 | 0.104 | 0.075 | 0.079 | 0.072 |
| Temperature dependency $(T100 - T140)/40 \times 10^4$ | 4.8 | 3.3 | 2.0 | 1.5 | 1.5 | 1.8 | 3.5 | 3.8 | 3.3 | 3.3 |
| Shifting characteristics μ0/μd | 0.96 | 0.99 | 1.00 | 1.03 | 1.00 | 1.01 | 0.99 | 0.98 | 0.99 | 0.99 |
| Anti-shudder durability h | 168 | 144 | 144 | 120 | 120 | 120 | 48 | 120 | 120 | 144 |

1)hydrocracked base oil (100° C. kinematic viscosity: 2.6 $mm^2/s$, viscosity index: 105, NOACK evaporation loss: 52 mass %, S: 0.1 mass % or less)

2)hydrocracked base oil (100° C. kinematic viscosity: 4.0 $mm^2/s$, viscosity index: 125, NOACK evaporation loss: 16 mass %, S: 0.1 mass % or less)

3)calcium sulfonate (base number: 300 mgKOH/g, Ca: 12.5 mass %)

4)calcium carbonate overbased salt of alkylsalicylic acid calcium salt having C14 to C18 secondary alkyl group (Base number: 170 mg KOH/g, Ca: 6 mass %, Structure of alkylsalicylic carbonate: 3-alkyl: 53 mol %, 4-alkyl: 4 mol %, 5-alkyl: 35 mol %, 3,5-dialkyl: 8 mol %)

5)boric acid-modified polybutenyl succinimide a: Mn of PIB group: 1300, nitrogen: 1.5 mass %, boron: 0.5 mass %, B/N ratio: 0.33 b: Mn of PIB group: 1300, nitrogen: 2.3 mass %, boron: 2.0 mass %, B/N ratio: 0.87 c: mixture of a and b (1:1)

6)alkanolamine-type, fatty acid metal salt 7)diphenylphosphite (phosphorus content: 13.2 mass %)

8)polybutenyl succinimide type ashless dispersant (Mn of PIB group: 1000, nitrogen: 2.15 mass %)

9)dialkyldiphenylamine 10)bisphenolic anti-oxidant

11)PMA type viscosity index improver

The invention claimed is:

1. A lubricating oil composition comprising a base oil and, on the basis of the total mass of the composition, (A) a calcium sulfonate detergent in an amount of 0.02 to 0.2 percent by mass in terms of metal (MeA);

(B) a calcium salicylate detergent in an amount of 0.01 to 0.05 percent by mass, in terms of metal (MeB); and (C) a boron-containing succinimide type ashless dispersant in an amount of 0.005 to 0.02 percent by mass in terms of boron (BoC);

(MeB)/(MeA) being 0.05 to 1.0, and (MeA)/(BoC) being from 2.5 to 7.3, wherein the composition further comprises (E) a friction modifier comprising at least one type selected from the group consisting of amine-, amide-, and fatty acid-type friction modifiers in an amount of 0.01 to 5 percent mass and (F) a phosphorus-containing anti-wear agent which is selected from the group consisting of phosphorous acid esters having an alkyl group having 4 to 20 carbon atoms and phosphorous acid esters having an (alkyl) aryl group having 6 to 12 carbon atoms in an amount of 0.01 to 0.06 percent by mass in terms of phosphorous;

wherein the base oil is a mixture of (a) a base oil having a kinematic viscosity at 100° C. of 1.5 to 3.5 $mm^2/s$ and (b) a base oil having a kinematic viscosity at 100° C. of 3.5 to 6 $mm^2/s$ which are mixed in a mass ratio of (a):(b) of 10:90 to 90:10.

2. The lubricating oil composition according to claim 1, further comprising (D) a triazole compound in an amount of 0.01 to 5 percent by mass.

3. The lubricating oil composition according to claim 1, wherein Component (B) is an alkylsalicylic acid metal salt and/or an (overbased) basic salt thereof, wherein the component ratio of the monoalkylsalicylic acid metal salt is from 85 to 100 percent by mole, the component ratio of the dialkylsalicylic acid metal salt is from 0 to 15 percent by mole and the component ratio of the 3-alkylsalicylic acid metal salt is from 40 to 100 percent by mole.

4. A method for improving torque capacity, shifting characteristics, and anti-shudder properties in automatic transmissions and/or continuously variable transmissions comprising lubricating the transmissions with a lubricating oil composition according to claim 1.

5. The method according to claim 4 wherein said automatic transmissions and/or continuously variable transmissions are provided with aramid or cellulose wet-type friction materials.

6. The method according to claim 4 wherein said automatic transmissions and/or continuously variable transmissions are provided with wet-type friction materials containing carbonaceous materials.

* * * * *